US011604430B2

(12) United States Patent
Hasegawa

(10) Patent No.: US 11,604,430 B2
(45) Date of Patent: Mar. 14, 2023

(54) IMAGE FORMING APPARATUS AND IMAGE FORMING METHOD

(71) Applicant: SHARP KABUSHIKI KAISHA, Sakai (JP)

(72) Inventor: Naoki Hasegawa, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/538,202

(22) Filed: Nov. 30, 2021

(65) Prior Publication Data

US 2022/0179350 A1 Jun. 9, 2022

(30) Foreign Application Priority Data

Dec. 3, 2020 (JP) ..... JP2020-201086

(51) Int. Cl.
*G03G 15/00* (2006.01)
*B65H 7/14* (2006.01)
*B65H 1/26* (2006.01)

(52) U.S. Cl.
CPC ..... *G03G 15/70* (2013.01); *B65H 1/26* (2013.01); *B65H 7/14* (2013.01)

(58) Field of Classification Search
CPC ..... B65H 7/14; B65H 1/26; G03G 15/70
See application file for complete search history.

(56) References Cited

U.S. PATENT DOCUMENTS 8,925,799 B1 * 1/2015 Harty ..... G07F 19/209 235/379
2011/0172961 A1 * 7/2011 Sunata ..... G06F 11/0733 702/179
2012/0293824 A1 11/2012 Ogasawara
2015/0363680 A1 * 12/2015 Shimazu ..... G03G 21/02 358/1.14
2019/0235801 A1 * 8/2019 Shimazaki ..... H04N 1/00127
2019/0268483 A1 * 8/2019 Sakashita ..... H04N 1/00405

FOREIGN PATENT DOCUMENTS

JP 2011-152983 A 8/2011
JP 2012-203412 A 10/2012

* cited by examiner

*Primary Examiner* — David H Banh
(74) *Attorney, Agent, or Firm* — ScienBiziP, P.C.

(57) ABSTRACT

An image forming apparatus includes: a feed tray that contains printing paper therein; a user authentication unit that authenticates a user who is permitted to print; a paper loading detection unit that detects printing paper loaded into the feed tray; a memory device that stores a user authenticated as a paper-supplementing user; a paper feeding mechanism that feeds the printing paper from the feed tray; a paper jam detection unit that detects a paper jam; and a controller that controls a print job. The controller, when a paper jam has occurred, determines whether or not the paper jam is due to the paper-supplementing user having loaded the printing paper in an improper manner. Upon determining that the paper jam is due to the paper-supplementing user having loaded the printing paper in an improper manner, the controller, subsequently when the paper-supplementing user uses, requests that a loading condition be checked.

6 Claims, 8 Drawing Sheets

FIG. 7

ATTRIBUTE DATA FOR FEED TRAY OF INTEREST

| | CURRENT SETTING |
|---|---|
| PAPER SIZE | A4 |
| PAPER TYPE | NORMAL |
| PAPER HEIGHT | 55% |
| AVAILABILITY OF PAPER | AVAILABLE |
| PAPER-SUPPLEMENTING USER | USER C |
| USER LEVEL | CARELESS USER |
| LOGIN USER | USER A |
| USER LEVEL | CARELESS USER |
| PAPER LOADING CHECK STATUS | CHECKED |
| PAPER JAM COUNTER | 1 |
| THRESHOLD VALUE | 5 |
| : | : |

| CONDITION IMMEDIATELY BEFORE FEED TRAY IS PULLED OUT AND PUSHED BACK IN |
|---|
| 60% |
| AVAILABLE |

COMMON DATA FOR AT LEAST SAME TYPE OF FEED TRAYS

| PAPER-SUPPLEMENTING-USER HISTORY | | |
|---|---|---|
| LOADING DATE & TIME | PAPER-SUPPLEMENTING USER | USER LEVEL |
| 2020.11.11.07.58 | USER B | GENERAL USER |
| 2020.11.10.08.46 | USER C | CARELESS USER |
| 2020.11.08.15.23 | USER D | GENERAL USER |
| 2020.11.07.11.34 | USER A | CARELESS USER |
| : | : | : |

IMAGE FORMING APPARATUS AND IMAGE FORMING METHOD

CROSS-REFERENCE TO RELATED APPLICATION

The present application claims priority from Japanese Patent Application Number 2020-201086, the content to which is hereby incorporated by reference into this application.

BACKGROUND OF THE INVENTION

1. Field of the Invention

The present invention, in an aspect thereof, relates to an image forming apparatus and an image forming apparatus method that, when it is reasonably inferred that paper jams have occurred due to improper loading of printing paper, request that the loading condition of the printing paper be checked.

2. Description of the Related Art

An image forming apparatus including one or more feed trays for loading printing paper determines that a paper jam (paper stuck in a paper feeder) has occurred when the printing paper fails to reach a paper passage sensor disposed in a transport path in a prescribed time after the paper feeding is started. The image forming apparatus then suspends the transport of printing paper and prompts the user to remove the jammed printing paper from the transport path through, for example, a message display or other means.

A paper jam can occur, for example, when the loaded printing paper is wrinkled, too thick, or otherwise unsuitable. However, suitable printing paper could still cause a paper jam when the printing paper is not properly loaded in the feed tray. For instance, if the paper guides for positioning the printing paper are adjusted excessively tightly, the paper guides may squeeze the printing paper and disrupt smooth paper feeding. On the other hand, if the paper guides are adjusted excessively loosely, the printing paper may not be loaded in the prescribed position, which could lead to oblique feeding and/or wrinkles and in turn to a paper jam.

The following technique is known regarding paper jams caused by printing paper.

When a paper jam occurs due to unsuitable transport of a sheet of paper from the paper tray toward the image generator, it is determined, for example, whether or not the sheet is the first one that is used after the paper feeding cassette was pulled out and pushed back in last time and whether or not the paper in the paper feeding cassette has not been used for an extended period of time. A message is then displayed in accordance with the cause of the jam. As an example, if the sheet is the first one that is used after the cassette was pulled out and pushed back in last time, but the paper is used regularly, it is determined that the paper is not properly loaded. A message is then displayed that may read: "Adjust or reload printing paper in cassette." See, for example, Japanese Unexamined Patent Application Publication, Tokukai, No. 2011-152983.

The following technique is known regarding the display of guidance used in the method of solving paper jams caused by printing paper.

If this is the first instance of a paper jam, the user is urged to restore the apparatus back into operation to resume the job by removing the jammed paper. Meanwhile, if jams occur successively in the same location, for example, a display is produced for an inquiry: "Front end of paper stuck in the fuser?" If "NO" is entered as a response to the inquiry, it is presumed that the paper is the cause of the jam, and guidance is displayed that may read: "Turn over copying paper before resuming photocopying." See, for example, Japanese Unexamined Patent Application Publication, Tokukai, No. 2012-203412.

SUMMARY OF THE INVENTION

The user who is using the feed tray when a paper jam occurs may not have loaded the printing paper into the feed tray. If another user has loaded the printing paper in an improper manner, these conventional techniques cannot inform the user who has actually loaded the printing paper of the paper jam caused by improper loading, failing to call for attention from that user.

In other words, the techniques fall short of informing the user who has loaded the printing paper of the paper jam to call for attention from the user if the user who has improperly loaded the printing paper into the feed tray is a different person from the user who is using the feed tray when a paper jam occurs after the loading.

The present invention, in an aspect thereof, has been made in view of these issues and has an object to enable calling for attention from the user who has actually loaded the paper when a jam has occurred due likely to improper loading of printing paper into the feed tray.

The present invention, in an aspect thereof, provides an image forming apparatus including: a feed tray that contains printing paper therein; a user authentication unit that authenticates a user who is permitted to print; a paper loading detection unit that detects printing paper loaded into the feed tray; a memory device that stores a user authenticated when printing paper is loaded into the feed tray as a paper-supplementing user for the feed tray; a paper feeding mechanism that feeds the printing paper from the feed tray; a paper jam detection unit that detects a paper jam during the paper feeding; and a controller that controls a print job including the authentication of a user, the detection of loaded printing paper, the storing of a paper-supplementing user, and the detection of a paper jam, wherein the controller, when a paper jam has occurred, determines whether or not the paper jam is due to the paper-supplementing user having loaded the printing paper in an improper manner, and upon determining that the paper jam is due to the paper-supplementing user having loaded the printing paper in an improper manner, the controller, subsequently when the paper-supplementing user uses, requests that a loading condition be checked.

Viewed differently, the present invention, in an aspect thereof, provides an image forming method implemented by a controller for an image forming apparatus, the method including: authenticating a user who is permitted to print; detecting printing paper loaded into a feed tray through a paper loading detection unit; storing, in a memory device, a user authenticated when the printing paper is loaded into the feed tray as a paper-supplementing user for the feed tray; feeding the printing paper from the feed tray using a paper feeding mechanism; detecting a paper jam during the paper feeding through a paper jam detection unit; controlling printing on the printing paper having been fed; when a paper jam has occurred, determining whether or not the paper jam is due to the paper-supplementing user having loaded the printing paper in an improper manner; and upon determining that the paper jam is due to the paper-supplementing user having loaded the printing paper in an improper manner, subsequently when the paper-supplementing user uses, requesting that a loading condition be checked.

The image forming apparatus according to an aspect of the present invention includes a memory device that stores a user authenticated when printing paper is loaded into a feed tray as the paper-supplementing user for the feed tray. The controller, when a paper jam has occurred, determines whether or not the paper jam is due to the paper-supplementing user having loaded the printing paper in an improper manner. Furthermore, upon determining that the paper jam is due to the paper-supplementing user having loaded the printing paper in an improper manner, the controller, subsequently when the paper-supplementing user uses, requests that a loading condition be checked. The image forming apparatus can hence call for attention from the user who has actually loaded the printing paper, not from the authenticated user who is printing on the instance of a paper jam, when the paper jam has occurred due likely to improper loading of the printing paper into the feed tray. This mechanism can in turn reduce paper jams caused by improper loading of printing paper.

The image forming method according to an aspect of the present invention achieves similar functions and delivers similar advantages.

BRIEF DESCRIPTION OF THE DRAWINGS

FIG. 7 is a diagram depicting exemplary data used by the controller 110 in the process shown in FIGS. 4 to 6.

DETAILED DESCRIPTION OF THE INVENTION

The following will describe the present invention in further detail with reference to drawings. The description is for illustrative purposes only and by no means limits the scope of the invention.

Exemplary Structure of Image Forming Apparatus

Figure 1:
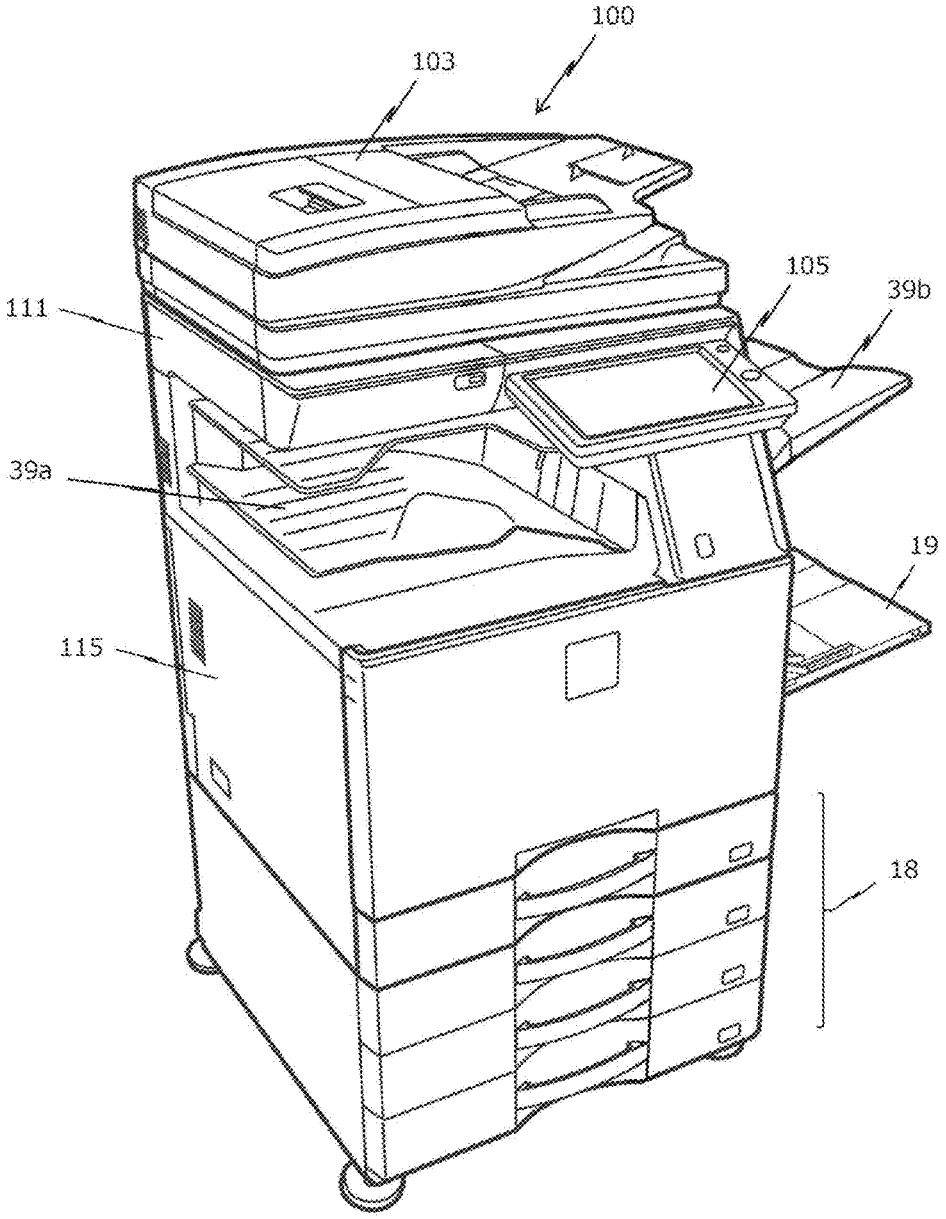
FIG. 1 is a perspective view of an appearance of a multifunction printer that is an embodiment of an image forming apparatus in accordance with the present invention.
Figure 2:
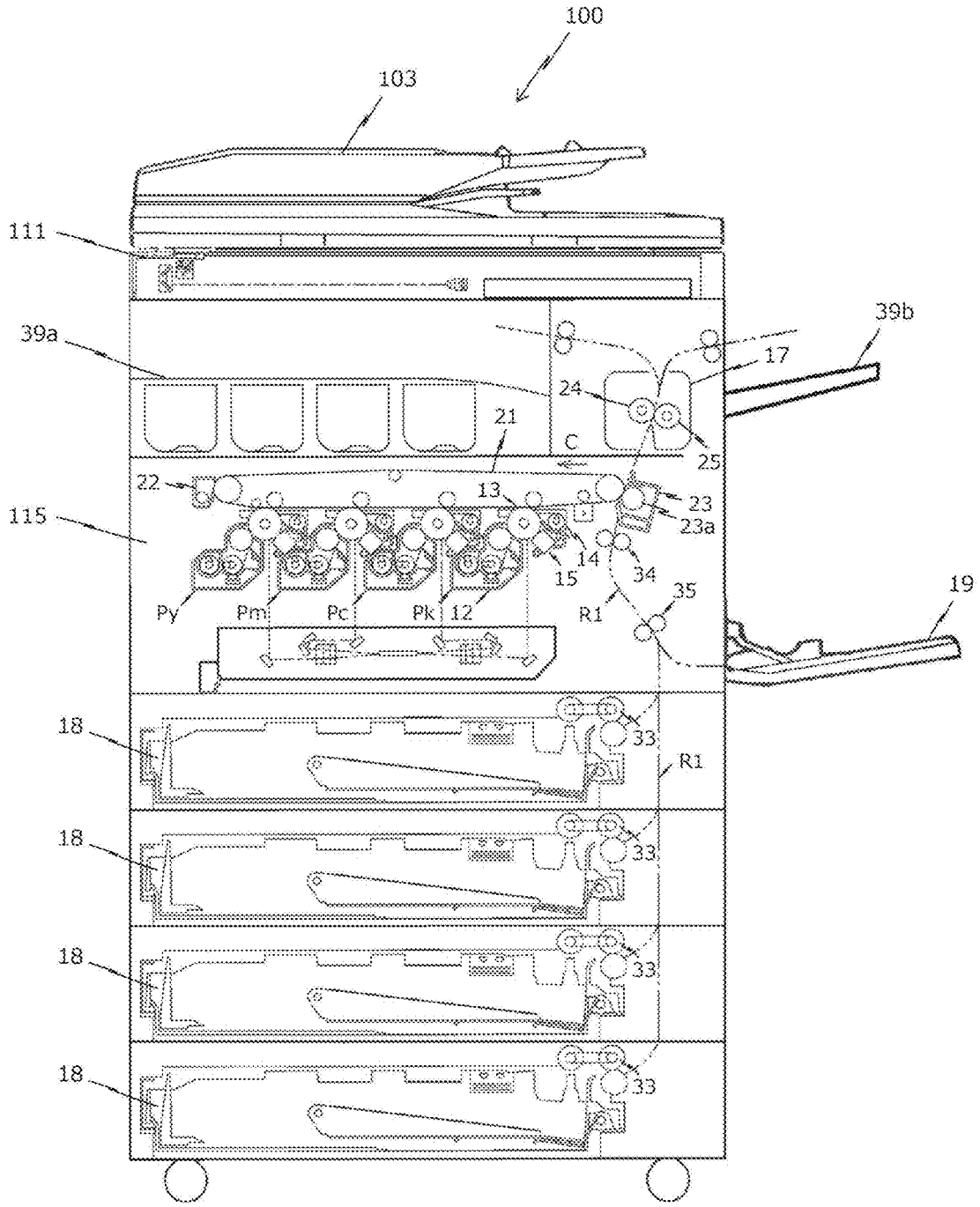
FIG. 2 is a cross-sectional view of a mechanical structure of the main body of the multifunction printer shown in FIG. 1.
Figure 3:
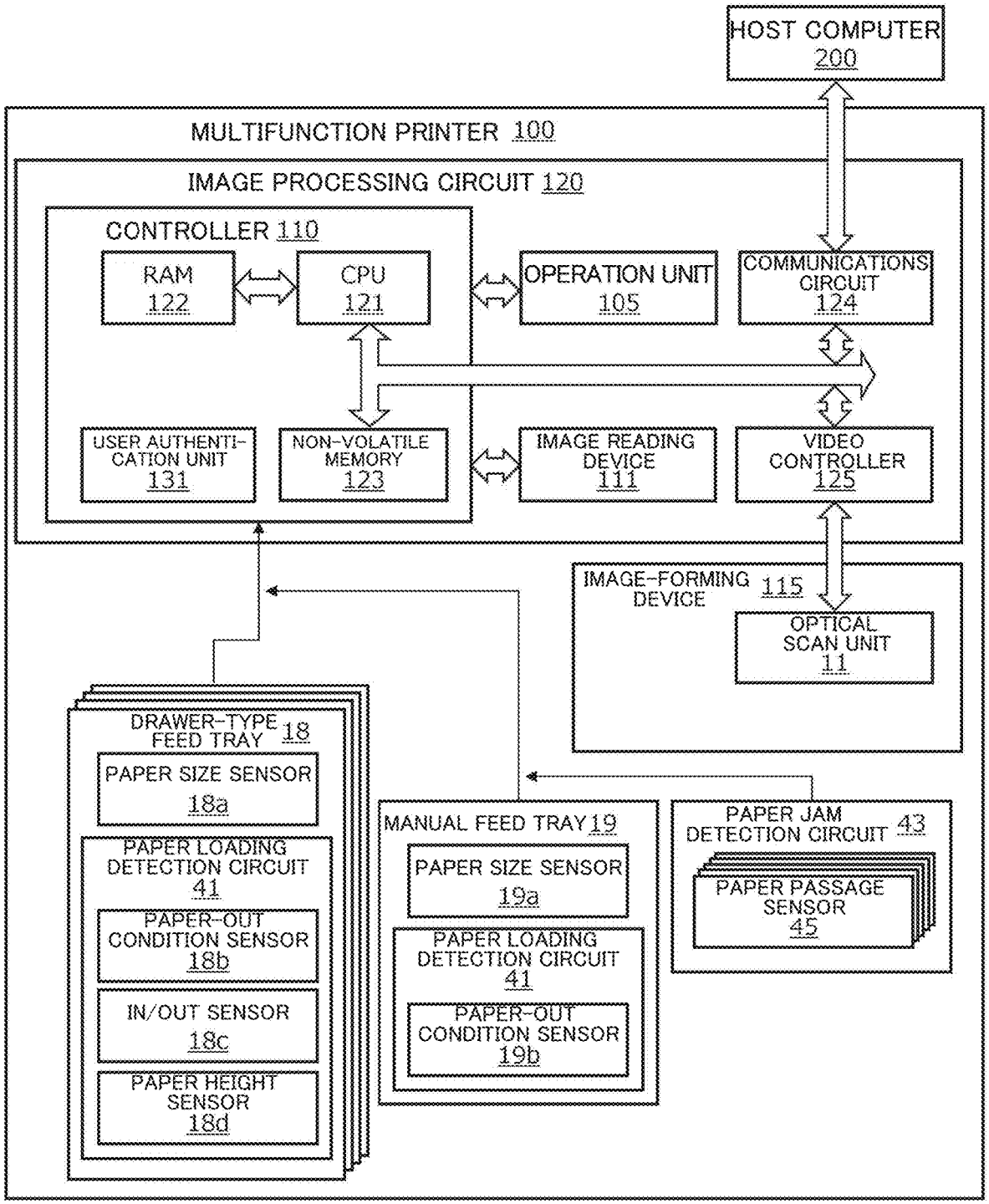
FIG. 3 is a block diagram of an electrical configuration of the multifunction printer 100 shown in FIGS. 1 and 2.

FIG. 1 is a perspective view of an appearance of a multifunction printer that is an embodiment of an image forming apparatus in accordance with the present invention. FIG. 2 is a cross-sectional view of a mechanical structure of the main body of a multifunction printer 100 shown in FIG. 1. FIG. 3 is a block diagram of an electrical configuration of the multifunction printer 100 shown in FIGS. 1 and 2.

Referring to FIGS. 1 and 3, the multifunction printer 100 includes: an operation unit 105; an image reading device 111 that captures an image of an original document; an image-forming device 115 that forms an image; four drawer-type feed trays 18 (feed trays 1 to 4 from top to bottom); and a manual feed tray 19. The multifunction printer 100 further includes: an original document transport unit 103 that transports the original document to a reading unit; and discharge trays 39*a* and 39*b*.

Each drawer-type feed tray 18 has a drawer-like structure in the present embodiment, so that the user can load printing paper into the tray when the drawer unit is pulled out. As the drawer unit is pushed back in that contains one or more sheets of printing paper in a prescribed position that matches the paper size, a controller 110 (detailed later) raises the top of the loaded printing paper to a prescribed paper feed position where there are provided pickup rollers 33. In other words, the drawer-type feed tray 18 is a "liftup tray." As the drawer-type feed tray 18 is pulled out, the printing paper is lowered from the paper feed position to a "liftdown" position.

On the other hand, the manual feed tray 19 has no liftup mechanism, but instead has pickup rollers (not shown in FIGS. 1 and 2) for vertical motion. As one or more sheets of printing paper is/are placed in a prescribed position that matches the paper size, the printing paper in the manual feed tray 19 is ready to be fed. To actually feed the paper, the pickup rollers are lowered so as to guide the topmost sheet to a sheet transport path R1.

The drawer-type feed tray 18, in the present embodiment, includes: a paper size sensor 18*a* that detects the size of the printing paper loaded therein; and a paper-out condition sensor 18*b* that detects the presence/absence of printing paper. The drawer-type feed tray 18 further includes: an in/out sensor 18*c* that detects whether or not the drawer unit is pushed in; and a paper height sensor 18*d* that detects the stack size of the loaded printing paper on the basis of a liftup amount of the printing paper measured when the drawer unit is pushed in.

The manual feed tray 19 includes: a paper size sensor 19*a* that detects the size of the loaded printing paper; and a paper-out condition sensor 19*b* that detects the presence/absence of printing paper.

Referring to FIG. 3, the paper-out condition sensor 18*b*, the in/out sensor 18*c*, and the paper height sensor 18*d* of each drawer-type feed tray 18 constitute a part of a paper loading detection circuit 41. The paper-out condition sensor 19*b* of the manual feed tray 19 constitutes a part of the paper loading detection circuit 41.

There are provided paper passage sensors 45 along the sheet transport path R1 near the drawer-type feed trays 18 and the manual feed tray 19, to detect the passage of printing paper fed into the sheet transport path R1. The paper passage sensors 45 constitute at least a part of a paper jam detection circuit 43.

A brief description is given here of the internal structure of the multifunction printer 100 shown in FIG. 2.

The multifunction printer 100 prints a color image on a printing sheet using black (K), cyan (C), magenta (M), and yellow (Y) colors. Alternatively, the multifunction printer 100 prints a monochrome image on a printing sheet using a single color (e.g., black). The multifunction printer 100 hence includes, for example, four developing units 12, four photosensitive drums 13, four drum cleaning devices 14, and four chargers 15. These components are associated with black, cyan, magenta, and yellow to form four toner images of different colors, thus constituting four image stations Pk, Pc, Pm, and Py.

A toner image is formed in the following manner in all the image stations Pk, Pc, Pm, and Py. The drum cleaning device 14 removes and collects residual toner from the surface of the photosensitive drum 13. Subsequently, the charger 15 charges the surface of the photosensitive drum 13 uniformly to a prescribed electrical potential. An optical scan unit 11 then scans the uniformly charged surface to expose the surface to light, thereby forming an electrostatic latent image on the surface. The electrostatic latent image is developed by the developing unit 12. These procedures form a toner image of a specific color on the surface of the photosensitive drum 13. The developing unit 12 contains a developer composed primarily of toner and carrier.

An intermediate transfer belt 21 rotates in the direction indicated by arrow C. A belt cleaning unit 22 removes and collects residual toner from the rotating intermediate transfer belt 21. The toner images of the four colors formed on the surfaces of the photosensitive drums 13 are sequentially transferred and superimposed onto the intermediate transfer belt 21, to form a color toner image on the intermediate transfer belt 21.

Each drawer-type feed tray 18, which is a type of feed tray, contains paper to feed the paper to a secondary transfer unit 23. The drawer-type feed trays 18 contain four different types of paper respectively as shown in FIG. 2.

The manual feed tray 19, which is also a type of feed tray, feeds the paper placed in a prescribed position to the secondary transfer unit 23. The manual feed tray 19, in the present embodiment, includes a size detection mechanism and a paper sensor that detects the presence/absence of paper in the prescribed position.

A printing sheet is drawn by the pickup rollers 33 from any one of the four drawer-type feed trays 18 by the pickup rollers 33 and fed to the secondary transfer unit 23 via the sheet transport path R1. Alternatively, a printing sheet is fed by pickup rollers (not shown) from the manual feed tray 19 to the secondary transfer unit 23 via the sheet transport path R1. The paper passage sensors 45 are disposed downstream of the pickup rollers on the sheet transport path R1 (see FIG. 3). There are provided registration rollers 34 on the sheet transport path R1 to temporarily stop the printing sheet and adjust the front end of the printing sheet. There are also provided, for example, transport rollers 35 to assist and facilitate the transport of the printing sheet. The registration rollers 34 temporarily stop the printing sheet and then transport the printing sheet to a nip region between the intermediate transfer belt 21 and a secondary transfer roller 23*a* at the right timing for toner image transfer.

A color toner image formed on the surface of the intermediate transfer belt 21 is transferred to the printing sheet when the printing sheet passes through the nip region. After passing through the nip region, the printing sheet is sandwiched between a heating roller 24 and a pressure roller 25 both in a fusing unit 17 for heating and pressurization. This heating and pressurization fuses the color toner image onto the printing sheet.

Having passed through the fusing unit 17, the printing sheet is guided by a transport path switching mechanism (not shown) operating under the control of the controller 110 (detailed later), so as to be discharged to either the discharge tray 39*a* or the discharge tray 39*b*.

The multifunction printer 100 further includes an image processing circuit 120 as shown in FIG. 3.

The image processing circuit 120 includes the controller 110, a communications circuit 124, and a video controller 125. The image processing circuit 120 may further include a circuit for image processing (not shown in FIG. 3). The circuit is, for example, for processing an image of the original document captured by the image reading device 111.

The controller 110 includes a CPU (processor) 121, a RAM 122, and a non-volatile memory 123. The non-volatile memory 123 includes a flash memory or a HDD to store in advance control programs executed by the CPU 121. The non-volatile memory 123 further stores attribute data such as paper-supplementing users for each of the drawer-type feed trays 18 and the manual feed tray 19. The RAM 122 stores data for use in processes executed by CPU and other data such as images related to image formation. The CPU 121 executes the control programs stored in the non-volatile memory 123 to control data processing and the operation of each component of the multifunction printer 100 shown in FIG. 2.

The controller 110 includes a user authentication unit 131 to perform user authentication. There are various forms of user authentication. As an example, when a contactless card or an IC tag is used in authentication or biometric authentication is done based on fingerprint or face recognition, the hardware resources used in the user authentication are a part of the user authentication unit 131. As another example, when the user ID and the password are used, the user authentication unit 131 is a functional element because required hardware resources can be provided by, for example, the operation unit 105 and the non-volatile memory 123.

The operation unit 105 includes hardware resources including: input means such as operation keys and a touch panel; and a liquid crystal display device as display means. The operation keys and the touch panel receive manual operations from users. The controller 110 recognizes the received manual operations made by users and controls the liquid crystal display device to display an operation screen showing, for example, the condition and settings for the multifunction printer 100.

The communications circuit 124 is an interface circuit that connects the multifunction printer 100 to a LAN (local area network) or other like network to establish communications with an external device such as a host computer 200.

The video controller 125 generates scan signals related to the image to be printed and sends the scan signals to the optical scan unit 11. Through the scan signals, the optical scan unit is controlled for scanning and exposure, and an electrostatic latent image that matches the image to be printed is formed on the surface of the photosensitive drum 13.

Calling for Attention from User Regarding Paper Jams

A description is given next of the process of the controller 110 calling for attention from the user regarding paper jams in the present embodiment.

Figure 4:
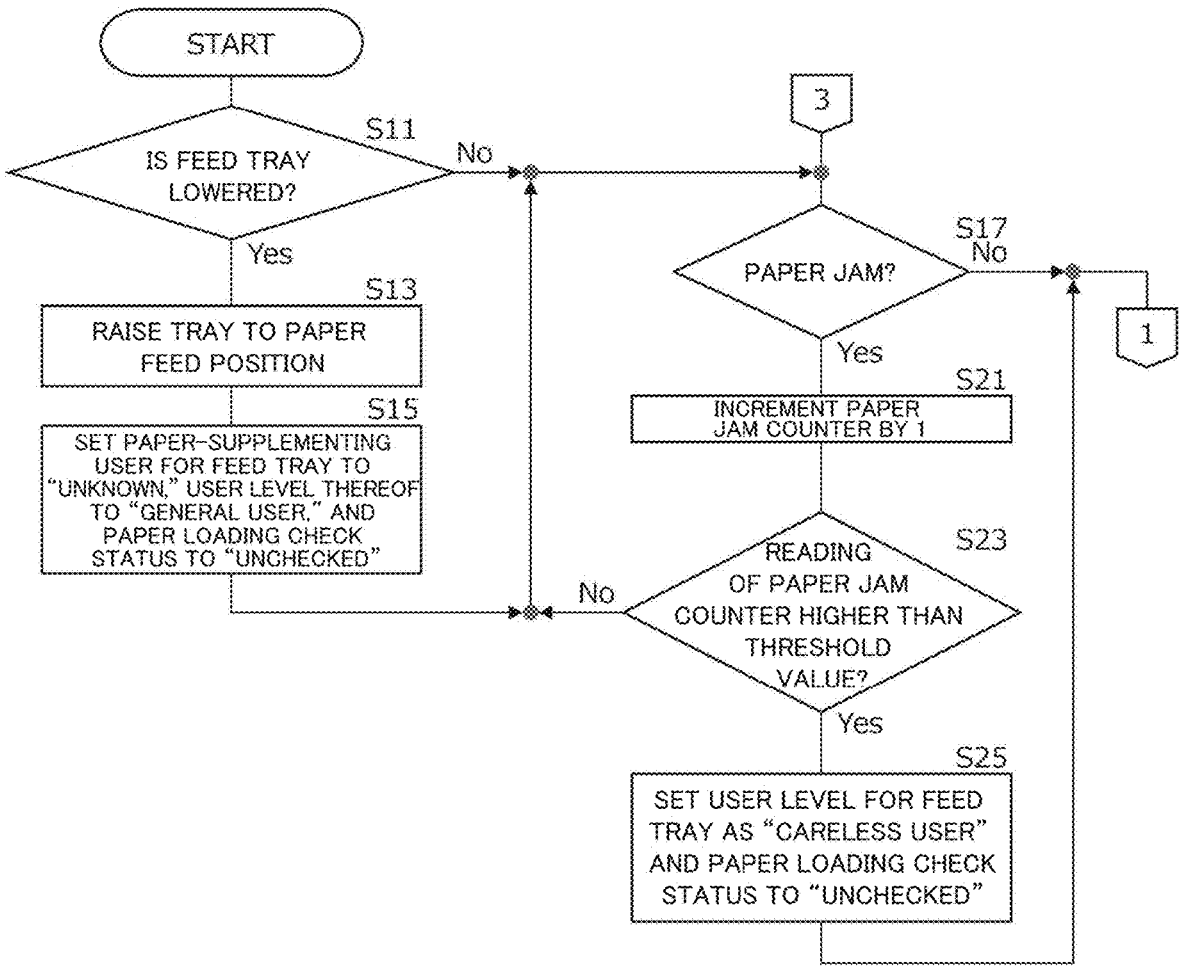
FIG. 4 is a first flow chart representing a process implemented by a controller in the present embodiment to call the user's attention to a paper jam.
Figure 5:
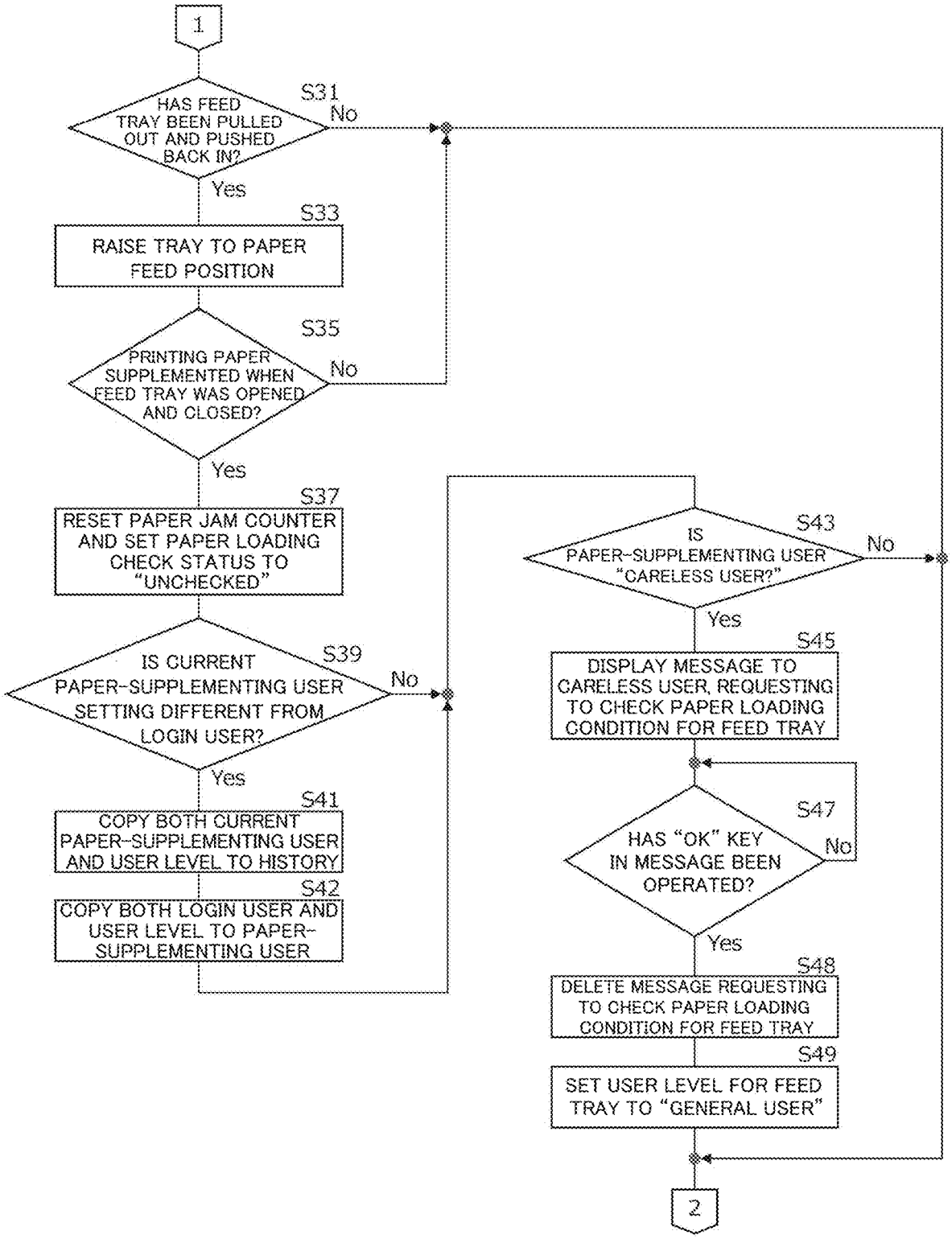
FIG. 5 is a second flow chart representing the process implemented by the controller in the present embodiment to call the user's attention to a paper jam.
Figure 6:
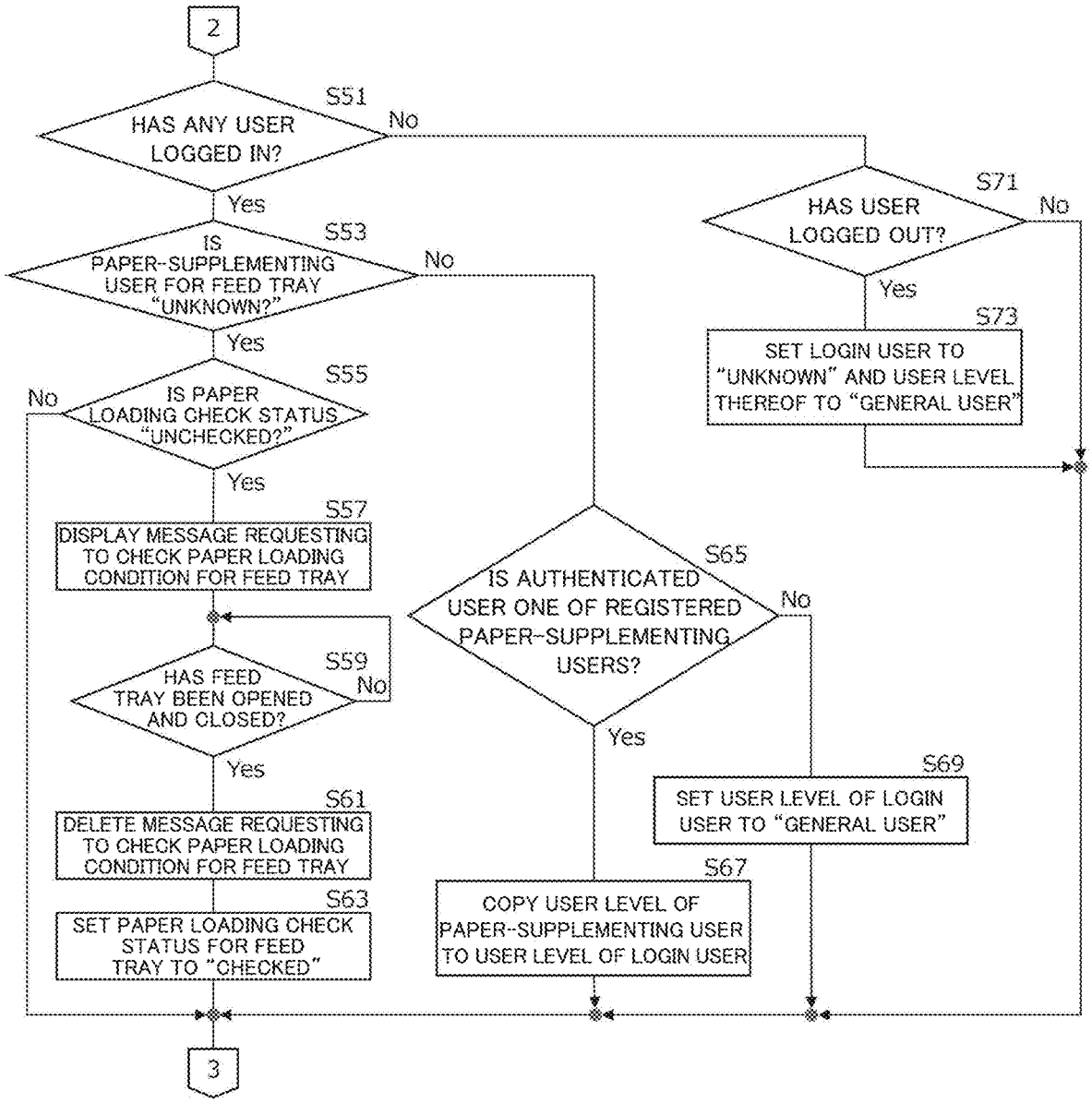
FIG. 6 is a third flow chart representing the process implemented by the controller in the present embodiment to call the user's attention to a paper jam.

FIGS. 4 to 6 are flow charts representing the process of calling the user's attention to paper jams, which is one of the processes implemented by the controller 110 in the present embodiment. FIG. 7 is a diagram depicting exemplary data used by the controller 110 in the process shown in FIGS. 4 to 6. The flow charts in FIGS. 4 to 6 include preferred aspects as well as the basic aspect of the present embodiment. The data shown in FIG. 7 may be all stored in the non-volatile memory 123. Alternatively, the part of the attribute data that represents the current status may be stored in the RAM 122. For instance, when the power supply is on, items such as the paper size, availability of paper (including paper-out condition), and login user may be stored in the RAM 122, not in the non-volatile memory 123, because the current status is detected by the paper size sensor and other sensors.

As the power supply for the multifunction printer 100 is turned on, the controller 110 starts the process shown in FIGS. 4 to 6 as one of the tasks that are activated subsequently to an initialization process. The tasks shown in FIGS. 4 to 6 are performed parallel to other tasks (multitasking). The controller 110 also executes the process shown in FIGS. 4 to 6 for each of the four drawer-type feed trays 18. The controller 110 also executes a similar process on the manual feed tray 19.

Referring to FIG. 4, subsequently to the power supply being turned on, the controller 110 determines whether or not the feed tray is lowered (step S11). If the feed tray is lowered ("Yes" in step S11), it is indicated that the feed tray of interest was pulled out while the power supply was off. The controller 110 therefore determines that there is a possibility of supplemental printing paper having been loaded into the feed tray of interest.

The controller 110 first has the lowered tray raised to the paper feed position (step S13). The controller 110 then sets the entry for the item, "Paper-supplementing User," to "Unknown." This item is an attribute data item for the feed tray of interest shown in FIG. 7 where the user who has loaded printing paper is registered. In other words, it is assumed that an unknown user has loaded printing paper.

The controller 110 further sets the entry for a sub-item for a user level attribute of the paper-supplementing user to "General User." This sub-item indicates whether or not there is a need to call for attention from the user. There is no need to call for attention from a "General User." On the other hand, the setting, "Careless User," indicates that attention should be called for from the user. When the paper-supplementing user is unknown, or unspecified, the entry for the item, "Paper-supplementing User," is set to "Unknown," and the entry for the user level item is set to "General User," because the invention is not intended to call for attention from an unspecified paper-supplementing user.

The controller 110 further sets the entry for another attribute data item for the feed tray of interest, "Paper Loading Check Status," to "Unchecked" to indicate that the status is yet to be checked. The paper loading check status indicates whether or not an authenticated user who is going to print has checked the condition of the supplemental printing paper previously loaded by an unknown user into the feed tray of interest. The entry is set to "Unchecked" if the condition of the loaded paper is yet to be checked and to "Checked" if the condition has been checked (step S15).

Subsequent to steps S11 to S15 following the turning-on of the power supply, the controller 110 goes into a loop for continuous monitoring. This continuous-monitoring loop process follows a loop through "No" in step S17 shown in FIG. 4, "No" in step S31 shown in FIG. 5, "No" in step S51 shown in FIG. 6, and "No" in step S71 shown in FIG. 6, and returns to step S17 shown in FIG. 4.

If the feed tray of interest is not lowered step S11 described above, in other words, if the feed tray is in the paper feed position ("No" in step S11), the controller 110 proceeds to step S17 where the continuous-monitoring loop process is started, in which case the attribute data for the feed tray of interest remains the same as it was before the power supply was turned off.

The controller 110 proceeds to step S17 of the continuous-monitoring loop process. A description is given next of a few events monitored for by the controller 110 in the continuous-monitoring loop process and steps followed when such an event happens.

A description is given first of the steps followed when a paper jam occurs. This event is described in step S17.

The controller 110 monitors whether or not a paper jam has occurred during the transport of paper from the feed tray of interest (step S17).

If there has occurred a paper jam ("Yes" in step S17), the controller 110 increments the paper jam counter by 1 (step S21). The controller 110 then determines whether or not the reading of the paper jam counter has exceeded a predetermined threshold value (step S23).

If the reading of the paper jam counter has not exceeded the predetermined threshold value, the controller 110 returns the process to the continuous-monitoring loop.

The paper jam counter counts paper jams that have occurred during the transport of paper from the feed tray of interest. The controller 110 resets the paper jam counter upon determining that printing paper has been loaded into the feed tray of interest and increments the paper jam counter by 1 if there has occurred a paper jam during the transport of paper from the feed tray of interest. Step S21 corresponds to this incrementing step.

The threshold value used in step S23 may be a predetermined invariable value and may be adaptively determined so as to reflect the situation prior to the loading of printing paper. As an example of such an adaptively determined threshold value, a value may be determined on the basis of the frequency of paper jams that occurred prior to the last loading of printing paper. The use of an adaptively determined value as the threshold value enables the detection of an increase that may occur in the frequency (occurrence rate) of paper jams after the last loading of printing paper as compared with before the last loading of printing paper and that exceeds a prescribed fraction.

If it is determined in step S23 that the reading of the paper jam counter has exceeded the threshold value, the controller 110 sets the user level (one of attribute data items) for the feed tray of interest to "Careless User" (step S25), so that if the login user who later loads supplemental printing paper in the feed tray matches the paper-supplementing user registered as a "Careless User," the controller 110 can call for attention from the login user.

In the current context, the controller 110 does not only store the paper-supplementing user as attribute data representative of the current condition of the feed tray, but also stores, in the non-volatile memory 123, a history containing paper-supplementing users who ever loaded printing paper to the feed trays, as shown in FIG. 7. This paper-supplementing-user history may be created separately for each feed tray. Preferably, however, at least the same type of feed trays share a common history. A single history may be created covering all feed trays.

A further description is given of the paper-supplementing-user history. Upon printing paper being loaded into the feed tray of interest, the controller 110 sets the paper-supplementing user that is an attribute data item representing the current status to the user who is authenticated at the point in time (login user) because the login user is currently using the multifunction printer 100. Before that, the controller 110 moves the paper-supplementing user who has been registered for the feed tray of interest to the paper-supplementing-user history and registers that paper-supplementing user together with the date and time of the moving, in other words, information on the loading date and time representing the point in time when supplemental printing paper is loaded into the feed tray. The user level (sub-item) of the paper-supplementing user is moved together with the paper-supplementing user. If the paper-supplementing user that is moved is already registered in the paper-supplementing-user history, the existing history is deleted to avoid double registration of data in the history.

Meanwhile, the controller 110 receives new user authentication for use of the multifunction printer 100. Upon authentication of a new user, the controller 110 sets the login user (one of attribute data items) for the feed tray of interest to the authenticated user's ID. Then, the controller 110 checks whether or not the authenticated user (login user) is registered in the paper-supplementing-user history. If the login user is registered in the paper-supplementing-user history, the user level of that paper-supplementing user is copied to the user level of the login user. If the login user is not registered in the paper-supplementing-user history, the user level of the login user is set to "General User."

The controller 110 may delete old history that has lapsed a predetermined period in reference to the loading date and time registered in the paper-supplementing-user history for each paper-supplementing user. Alternatively, the controller 110 may delete part of the history, starting with the oldest data therein, when the paper-supplementing-user history has grown in excess of a prescribed size.

The description returns to the flow charts.

The controller 110, in step S25 shown in FIG. 4 described above, further sets the entry for the paper-loading-check-status item for the feed tray of interest to "Unchecked." The controller 110 then returns the process to the continuous-monitoring loop.

A description is given next of a process implemented when the feed tray of interest is detected to have been pulled out and pushed back in the continuous-monitoring loop process. The following description assumes that in the present embodiment, the paper size sensor 18*a*, the paper-out condition sensor 18*b*, and the paper height sensor 18*d* on each drawer-type feed tray 18 are disconnected from the controller 110 and hence disabled when the drawer-type feed tray 18 is pulled out and connected to the controller 110 and hence enabled when the feed tray of interest is pushed back in. This arrangement is for illustrative purposes only and does not limit the scope of the present invention.

The controller 110 determines in step S31 shown in FIG. 5 whether or not the feed tray of interest has been pulled out and pushed back in. If the controller 110 determines that the feed tray of interest has been pulled out ("Yes" in step S31), the controller 110 first raises the feed tray to the paper feed position (step S33). Upon completely raising the feed tray, the current stack size of printing paper (an approximate quantity of the printing paper contained in the feed tray of interest) is acquired on the basis of the liftup amount of the feed tray of interest. It is then determined whether or not supplemental printing paper has been loaded into the feed tray of interest when the feed tray is pulled out, by comparing the acquired current stack size of printing paper and the stack size prior to the feed tray being pulled out and pushed back in (step S35). The stack size (printing paper height) and the availability of paper (paper-out condition) of printing paper prior to the feed tray being pulled out and pushed back in are data items registered in the non-volatile memory 123 as shown in FIG. 7.

When the feed tray of interest is pulled out, the controller 110 copies the printing paper height and the availability of paper (paper-out condition) from the attribute data representative of the current condition of the feed tray of interest, in order to retain the condition immediately prior to the feed tray being pulled out and pushed back in. The controller 110 can determine whether or not printing paper has been loaded into the feed tray of interest, based on a change in at least any one of the printing paper height and the availability of paper (paper-out condition) before and after the feed tray is pulled out and pushed back in.

Upon determining that printing paper has not been loaded ("No" in step S35), the controller 110 returns the process to the steady monitoring loop.

Upon determining that supplemental printing paper has been loaded ("Yes" in step S35), the controller 110 resets the jam counter for the feed tray of interest and sets the paper loading check status to "Unchecked" (step S37) because supplemental printing paper has been loaded.

Subsequently, the controller 110 determines whether or not the paper-supplementing user that is an attribute data item representing the current status of the feed tray of interest differs from the current login user (step S39). If the paper-supplementing user differs from the current login user ("Yes" in step S39), the controller 110 first copies the paper-supplementing user to the paper-supplementing-user history, and at the same time registers information on the loading date and time. The controller 110 also moves the user level that is a sub-item for the paper-supplementing user together with the paper-supplementing user (step S41). If the paper-supplementing user to be moved is already registered in the paper-supplementing-user history, the existing history is deleted to avoid double registration. The controller 110 then copies the currently authenticated user, that is, the login user, to an item for the paper-supplementing user for the feed tray of interest. The controller 110 also copies the user level (sub-item) of the login user to the user level of the paper-supplementing user (step S42).

If the paper-supplementing user is the same person as the login user ("No" in step S39), the controller 110 skips steps S41 and S42 because there is no need to copy.

The controller 110 then determines whether or not the paper-supplementing user is a "Careless User," by referring to the user level item for the paper-supplementing user for the feed tray of interest (step S43).

If the user level is not "Careless User" ("No" in step S43), the controller 110 returns the process to the continuous-monitoring loop.

On the other hand, if the user level is "Careless User" ("Yes" in step S43), the controller 110 controls the operation unit 105 to display, to the careless user, a message requesting that the user check the paper loading condition of the feed tray (step S45).

Figure 8:
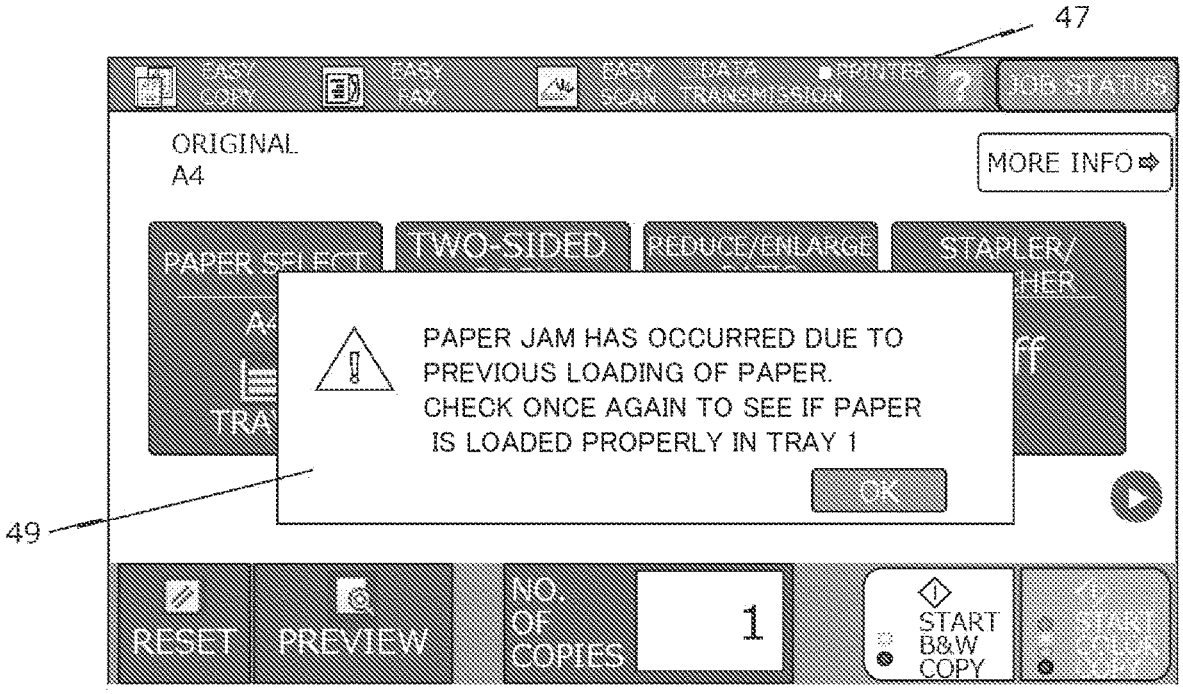
FIG. 8 is an illustration of an example of a paper-loading-condition-check-request message displayed under the control of the controller to a careless user in the present embodiment.

FIG. 8 is an illustration of an example of a paper-loading-condition-check-request message 49 displayed on a copy operation screen 47 of the operation unit 105 controlled by the controller 110 in the present embodiment. The paper-loading-condition-check-request message 49 shown in FIG. 8 is intended for careless users. When the paper-loading-condition-check-request message 49 is displayed, the user cannot start copying without operating an "OK" key displayed together with the message to delete the paper-loading-condition-check-request message 49.

Upon determining that the "OK" key displayed together with the paper-loading-condition-check-request message 49 has been operated ("Yes" in step S47), the controller 110 deletes the paper-loading-condition-check-request message 49 (step S48). In addition, the controller 110 changes the user level (one of attribute data items) for the feed tray of interest from "Careless User" to "General User" (step S49). The controller 110 then returns the process to the continuous-monitoring loop.

A description is given next of a process implemented when the user who has not logged in is authenticated in a user authentication in the continuous-monitoring loop process.

The controller 110 monitors whether or not a new user has been authenticated in the continuous-monitoring loop process (step S51 shown in FIG. 6). If the user has been authenticated ("Yes" in step S51), the controller 110 monitors whether or not the paper-supplementing user (one of attribute data items) for the feed tray of interest is "Unknown" (step S53). If the paper-supplementing user is "Unknown" (step S53), the controller 110 further checks whether or not the paper loading check status (one of attribute data items) for the feed tray of interest is "Unchecked" (step S55).

If any one of the results in steps S51, S53, and S55 is "No," the controller 110 returns the process to the continuous-monitoring loop.

If all the results in steps S51, S53, and S55 are "Yes," the controller 110 controls the operation unit 105 to display, to the current login user, a message requesting that the user check the paper loading condition of the feed tray (step S57).

Figure 9:
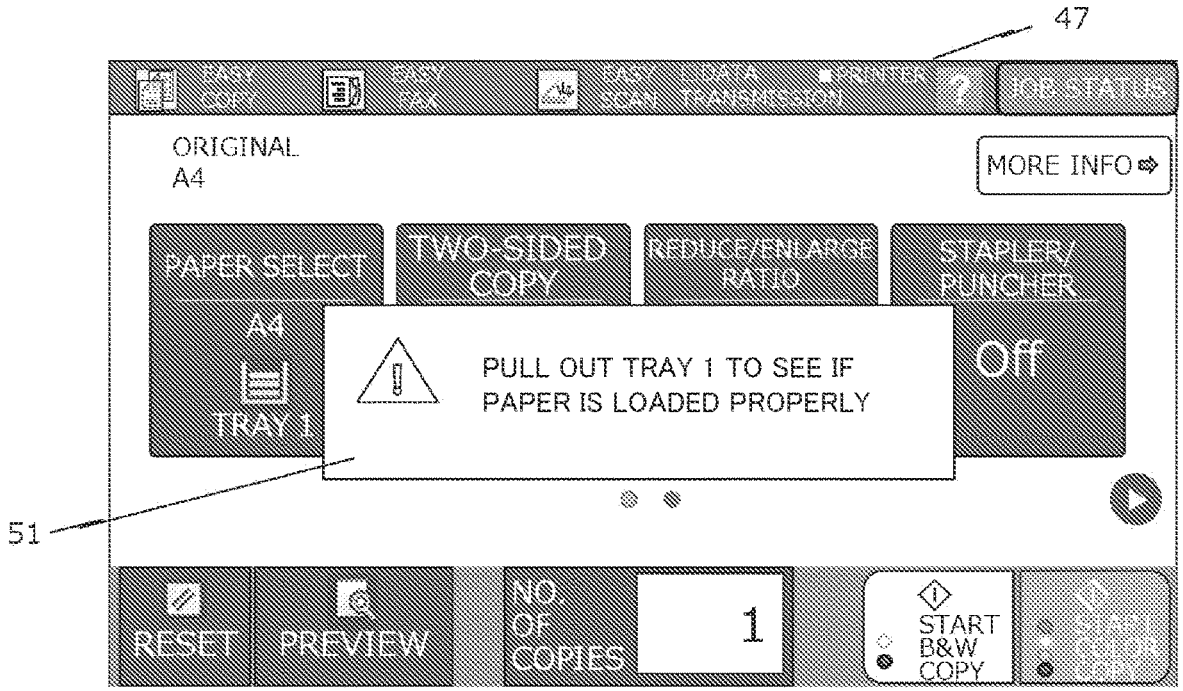
FIG. 9 is an illustration of an example of a paper-loading-condition-check-request message displayed on a copy operation screen under the control of the controller in the present embodiment.

FIG. 9 is an illustration of an example of a paper-loading-condition-check-request message 51 displayed on the copy operation screen 47 of the operation unit 105 controlled by the controller 110 in the present embodiment. The paper-loading-condition-check-request message 51 shown in FIG. 9 is intended to request that the user who logs in after an unknown user loaded printing paper check the condition of the loaded printing paper. When the user has pulled out the feed tray of interest in response to the displayed request message ("Yes" in step S59), the controller 110 deletes the paper-loading-condition-check-request message 51 (step S61). The controller 110 further sets the paper loading check status (one of attribute data items) for the feed tray of interest to "Checked" (step S63). The controller 110 then returns the process to the continuous-monitoring loop.

A description is given next of a process implemented when an authenticated user has logged out in the continuous-monitoring loop process.

The controller 110 monitors whether or not the login user has logged out in the continuous-monitoring loop process (step S71). If the user has logged out ("Yes" in step S71), the controller 110 sets the login user (one of attribute data items) for the feed tray of interest to "Unknown" and the user level of the login user to "General User" (step S73). The controller 110 then returns the process to the continuous-monitoring loop.

These steps provide the process implemented by the controller 110 to call the user's attention to a paper jam in the present embodiment.

Function to Call User's Attention to Paper Jam

The following description focuses on a function implemented through the process shown in FIGS. 4 to 6 to call for attention from the user.

The process shown in FIGS. 4 to 6 is related to a basic function as below.

It is assumed, as an example, that a feed tray 1 runs out of paper while the multifunction printer 100 is printing with User A being the login user, and User A responds by pulling out the feed tray 1, loading supplemental printing paper into the feed tray 1, and pushing the feed tray 1 back in.

In the continuous-monitoring loop process, upon detecting that the feed tray 1 has been pulled out and pushed back in, the controller 110 follows the Yes path in step S31 shown in FIG. 5. In response to the feed tray being pushed back in, the controller 110 has the feed tray raised (step S33) and determines, on the basis of a liftup amount (or according to whether or not there is paper left in the feed tray), that printing paper has been supplemented ("Yes" in step S35). The controller 110 then resets the paper jam counter and sets the paper loading check status to "Unchecked" (step S37). If User A, or the login user, differs from the paper-supplementing user who has been registered for the feed tray 1 ("Yes" in step S39), the controller 110 copies both the currently registered paper-supplementing user and the user level thereof to the history (step S41). The controller 110 then sets the paper-supplementing user for the feed tray 1 to User A (step S42). Assume that User A is not previously registered in the history. The controller 110 hence sets the user level to "General User."

The controller 110 follows the No path in subsequent step S41 and returns to the continuous-monitoring loop process.

Assume that User A loaded printing paper in an improperly manner. Assume further that User A loaded printing paper immediately before the print job for User A was completed and that no paper jams occurred until the print job for User A was completed. Thereafter, upon another User B logging in, the controller 110 follows the Yes path in step S51 of the continuous-monitoring loop process. However, User B is not an unknown user, and the controller 110 follows the No path in step S53. Subsequently, the controller 110 checks whether or not User B, who is the login user, is registered as the paper-supplementing user or in the paper-supplementing-user history for the feed tray 1 (step S65). If User B is registered in the history ("Yes" in step S65), the controller 110 copies the user level of User B to the user level of the login user (step S67). If User B is not registered in the history ("No" in step S65), the controller 110 sets the user level of the login user to "General User" (step S69). The controller 110 then returns to the continuous-monitoring loop.

Assume that a paper jam has occurred while the image forming apparatus is performing a print job for User B by using the printing paper in the feed tray 1.

In response to the paper jam, the controller 110 follows the Yes path in step S17 of the continuous-monitoring loop process. The controller 110 increments the paper jam counter by 1 (step S21) and determines whether or not the reading of the paper jam counter has exceeded a threshold value (step S23). Assume, as an example, that the threshold value is set to 2. Up to two paper jams, the controller 110 increments the paper jam counter by 1 and returns the process to the continuous-monitoring loop ("No" in step S23). Upon a third paper jam ("Yes" in step S23), the controller 110 changes the user level of User A, who is the paper-supplementing user for the feed tray 1, from the current level, "General User," to "Careless User" (step S25) and returns the process to the continuous-monitoring loop.

It is worth noting here that even if it is User B who is the login user for the multifunction printer 100 when the paper jam has occurred, the controller 110 changes the user level of User A who is the paper-supplementing user when the paper jam has occurred to "Careless User." The controller 110 returns the process to the continuous-monitoring loop without immediately causing a display of a message to the careless user.

It is also worth noting that even if a plurality of users logs in before the reading of the paper jam counter reaches the threshold value, the paper-supplementing user for the feed tray 1 is still User A. It is therefore the user level of User A that is changed to "Careless User."

User A is replaced by another login user if the other user (e.g., User B) logs in and printing paper is loaded into the feed tray 1 during that time (step S39 in FIG. 5). Subsequent paper jams or the lack of paper jams is/are treated as being related not to the loading of printing paper by User A, but to the loading by User B. When User B loads printing paper, the controller 110 registers User A who is the current paper-supplementing user together with the user level thereof in the paper-supplementing-user history.

Thereafter when User A has newly logged in, the controller 110 follows the Yes path in step S53 in the continuous-monitoring loop process. The controller 110 follows the No path in next step S53 because User A is the paper-supplementing user for the feed tray 1 and follows the Yes path in step S65 because User A is registered as the paper-supplementing user for the feed tray 1. The controller 110 then copies the user level, "Careless User," of User A, who is the paper-supplementing user, to the user level of the login user.

When User A supplements printing paper in the feed tray 1 while User A is logged in, the controller 110 follows the Yes path in step S31 in the continuous-monitoring loop process. The controller 110 follows the Yes path in step S35 and follows the No path in step S39 because User A is the login user and is also the paper-supplementing user.

Then, in step S43, the controller 110 follows the Yes path because User A, who is the paper-supplementing user, is a "Careless User" and controls the operation unit 105 to display a message prepared for the careless user (see FIG. 8).

As described here, the controller 110 retains the user who has supplemented printing paper in the feed tray 1 as the paper-supplementing user, and if there have occurred more paper jams than a prescribed criterion, has a message displayed next time when the paper-supplementing user supplements printing paper in the feed tray, to call for that user's attention. This is the basic function.

A description is given next of a function related to a preferred aspect of the present embodiment.

One of preferred functions is to, when failing to identify the user who has supplemented printing paper in a feed tray as a login user, request a subsequent login user to check the loading condition of the printing paper in the feed tray.

Take an example where printing paper is loaded into the feed tray 1 while the power supply is turned off. In this example, after the power supply is turned on, the controller 110 recognizes that the feed tray 1 is lowered and follows the Yes path in step S11. The controller 110 then sets the paper-supplementing user for the feed tray 1 to "Unknown" and simultaneously sets the user level to "General User" and the paper loading check status to "Unchecked." The controller 110 then returns the process to the continuous-monitoring loop process.

Thereafter, when a new user (e.g., User C) logs in, the controller 110 follows the Yes path in step S51 of the continuous-monitoring loop process. The controller 110 follows the Yes path in next step S53 because the paper-supplementing user for the feed tray 1 is "Unknown." The controller 110 follows the Yes path in step S55 and controls the operation unit 105 to display a message requesting that the user check the paper loading condition of the feed tray (see FIG. 9) because the paper loading check status is "Unchecked."

Then, when the feed tray 1 is pulled out and pushed back in (step S59), the controller 110 deletes the message (step S61) and sets the paper loading check status for the feed tray 1 to "Checked" (step S63). The controller 110 then returns the process to the continuous-monitoring loop.

Assume that User C subsequently logs out before another user (e.g., User D) logs in. In such a situation, the controller 110 does not have a message displayed requesting that the paper loading condition of the feed tray be checked when User D logs in because the paper loading check status is set to "Checked" in step S55.

Printing paper could be loaded into the feed tray 1 after the user logs out.

In response to the user logging out, the controller 110 follows the Yes path in step S71 of the continuous-monitoring loop process and sets the login user to "Unknown" (step S73). The controller 110 then returns the process to the continuous-monitoring loop.

In this condition, for example, when printing paper is loaded into the feed tray 1, the controller 110 follows the Yes path in step S31 of the continuous-monitoring loop process. The controller 110 then follows the Yes path in step S35 and sets the paper loading check status to "Unchecked" (step S37). The login user is "Unknown" in step S39. If the paper-supplementing user setting is not "Unknown" ("Yes" in step S39), the controller 110 copies to the history (step S41) and sets the paper-supplementing user to "Unknown" (step S42). In step S43, the user level is set to "General User" for "Unknown," so that no printing is permitted to the unknown user. In other words, no paper jam occurs. Therefore, the setting is always "General User," and the controller 110 follows the No path and returns the process to the continuous-monitoring loop.

Thereafter, when a new user logs in, the controller 110 follows the Yes path in step S51 of the continuous-monitoring loop process. The controller 110 follows the Yes path in next step S53 because the paper-supplementing user for the feed tray 1 is "Unknown." The controller 110 follows the Yes path in step S55 because the paper loading check status is "Unchecked" and controls the operation unit 105 to display a message requesting that the paper loading condition of the feed tray be checked (see FIG. 9).

This is a function related to a preferred aspect of the present embodiment.

As described in the foregoing, (i) the present invention, in an aspect thereof, is directed to an image forming apparatus including: a feed tray that contains printing paper therein; a user authentication unit that authenticates a user who is permitted to print; a paper loading detection unit that detects printing paper loaded into the feed tray; a memory device that stores a user authenticated when printing paper is loaded into the feed tray as a paper-supplementing user for the feed tray; a paper feeding mechanism that feeds the printing paper from the feed tray; a paper jam detection unit that detects a paper jam during the paper feeding; and a controller that controls a print job including the authentication of a user, the detection of loaded printing paper, the storing of a paper-supplementing user, and the detection of a paper jam, wherein the controller, when a paper jam has occurred, determines whether or not the paper jam is due to the paper-supplementing user having loaded the printing paper in an improper manner, and upon determining that the paper jam is due to the paper-supplementing user having loaded the printing paper in an improper manner, the controller, subsequently when the paper-supplementing user uses, requests that a loading condition be checked. (Embodiment 1)

In an aspect of the present invention, the feed tray holds printing paper in a prescribed position to feed the paper when printing. Specifically, the feed tray is, for example, a drawer-type liftup tray, a cassette-type tray, or a manual feed tray. The drawer-type liftup tray in accordance with the embodiment above is described in the embodiment on the assumption that this drawer-type liftup tray corresponds to the feed tray in accordance with an aspect of the present invention. The image forming apparatus may include a plurality of feed trays as does the multifunction printer described in the embodiment, in which case the memory device stores a paper-supplementing user for each feed tray, so that the controller can detect a paper jam for each feed tray and determine whether or not paper has been loaded in an improper manner.

As described earlier, the image forming apparatus includes a user authentication unit so as to only allow the authenticated user to print. Specifically, user authentication may be done, for example, using a user ID and a password. Alternatively, user authentication may be done, for example, using a contactless card or an IC tag, through fingerprint or face recognition or other like biometric technology, or using any other publicly known technology.

The paper loading detection unit detects new printing paper loaded into the feed tray. Specifically, the paper loading detection unit detects, for example, a change from a paper-out condition where the feed tray contains no printing paper to a condition where the feed tray contains printing paper. However, when it is detected that new printing paper has been supplemented in a non-paper-out condition, the controller also determines that printing paper has been loaded.

The paper loading detection circuit described the embodiment above corresponds to the paper loading detection unit in accordance with an aspect of the present invention. The paper jam detection circuit described the embodiment above corresponds to the paper jam detection unit in accordance with an aspect of the present invention.

The memory device is a non-volatile memory so that the memory device can record a paper-supplementing user for a feed tray even when the image forming apparatus is powered off. Specifically, the memory device is, but not limited to, for example, a flash memory or a HDD (hard disk drive). When new printing paper is loaded into a feed tray, the memory device stores the user authenticated when the printing paper is loaded as a paper-supplementing user. If the memory device already stores a paper-supplementing user, the memory device updates the paper-supplementing user.

A paper jam occurs by the controller determining, for example, that the printing paper having been fed has failed to reach a paper passage sensor disposed in a sheet transport path near the feed tray in a prescribed time or that the paper passage sensor has been continuously detecting the printing paper for longer than a prescribed period.

Upon determining that the paper jam is due to the paper-supplementing user having loaded the printing paper in an improper manner, the controller, subsequently when the paper-supplementing user uses, requests that a loading condition be checked. In the current context, the language, "subsequently when the paper-supplementing user uses," may refer to, for example, a time when the paper-supplementing user, having finished printing and temporarily logged out, is authenticated again. Alternatively, for example, the language may refer to a time when a re-authenticated user has loaded new printing paper into a feed tray for which the user is registered as a paper-supplementing user or a time when such a user has loaded new printing paper into another feed tray. The embodiment above gives an example where a re-authenticated user has loaded new printing paper into a feed tray for which the user is registered as a paper-supplementing user.

A description is given below of other preferred aspects of an aspect of the present invention.

(ii) If paper jam frequency is higher beyond a prescribed condition after the printing paper is loaded than before the printing paper is loaded, the controller may determine that the printing paper has been loaded in an improper manner. (Embodiment 2)

This particular arrangement enables the controller to, if paper jam frequency is higher after the printing paper is loaded than before the printing paper is loaded, determine that the printing paper has been loaded in an improper manner.

(iii) If printing paper is loaded into the feed tray when the image forming apparatus is powered off or when a user is yet to be authenticated, the controller may store the paper-supplementing user for the feed tray as being unknown in the memory device, and if printing paper is loaded by an unknown paper-supplementing user, the controller may request a user who is authenticated first after the loading to check a condition of the loaded printing paper. (Embodiment 3)

In this particular arrangement, if printing paper is loaded when a user is yet to be authenticated, the controller requests that a user who is subsequently authenticated check the condition of the printing paper. The arrangement can hence reduce paper jams caused by the improper loading of printing paper.

(iv) The paper loading detection unit may be a circuit that detects presence/absence of printing paper loaded into the feed tray.

This particular arrangement enables detecting a transition from a condition where the feed tray contains no printing paper to a condition where the feed tray contains printing paper. The arrangement hence enables detecting the loading of printing paper into a feed tray Embodiment 4

(v) The feed tray may be a drawer-type or detachable liftup tray, the paper loading detection unit may include a circuit that detects the feed tray being taken out and stored away or detached and reattached to raise the tray, and the controller may control the raising when the feed tray is taken out and stored away or detached and reattached, detect a stack size of the printing paper based on a raised position, and determine, based on a change that occurs in the stack size when the feed tray is taken out and stored away or detached and reattached, that new printing paper has been loaded. (Embodiment 5)

This particular arrangement, even when new printing paper is supplemented before the feed tray runs out of printing paper, still enables detecting the loading of printing paper into a feed tray on the basis of a change that occurs in the stack size when the feed tray is taken out and stored away or detached and reattached.

(vi) The present invention, in an aspect thereof, includes an image forming method implemented by a controller for an image forming apparatus, the method including: authenticating a user who is permitted to print; detecting printing paper loaded into a feed tray through a paper loading detection unit; storing, in a memory device, a user authenticated when the printing paper is loaded into the feed tray as a paper-supplementing user for the feed tray; feeding the printing paper from the feed tray using a paper feeding mechanism; detecting a paper jam during the paper feeding through a paper jam detection unit; controlling printing on the printing paper having been fed; when a paper jam has occurred, determining whether or not the paper jam is due to the paper-supplementing user having loaded the printing paper in an improper manner; and upon determining that the paper jam is due to the paper-supplementing user having loaded the printing paper in an improper manner, subsequently when the paper-supplementing user uses, requesting that a loading condition be checked.

While there have been described what are at present considered to be certain embodiments of the invention, it will be understood that various modifications may be made thereto, and it is intended that the appended claims cover all such modifications as fall within the true spirit and scope of the invention.

What is claimed is:

1. An image forming apparatus comprising:

a feed tray that contains printing paper therein;

a user authentication unit that authenticates a user who is permitted to print;

a paper loading detection unit that detects printing paper loaded into the feed tray;

a memory device that stores a user authenticated when printing paper is loaded into the feed tray as a paper-supplementing user for the feed tray;

a paper feeding mechanism that feeds the printing paper from the feed tray;

a paper jam detection unit that detects a paper jam during the paper feeding; and a controller that controls a print job including the authentication of a user, the detection of loaded printing paper, the storing of a paper-supplementing user, and the detection of a paper jam, wherein the controller, when a paper jam has occurred, determines whether or not the paper jam is due to the paper-supplementing user having loaded the printing paper in an improper manner, and upon determining that the paper jam is due to the paper-supplementing user having loaded the printing paper in an improper manner, the controller, subsequently when the paper-supplementing user uses, requests that a loading condition be checked.

2. The image forming apparatus according to claim 1, wherein if paper jam frequency is higher beyond a prescribed condition after the printing paper is loaded than before the printing paper is loaded, the controller determines that the printing paper has been loaded in an improper manner.

3. The image forming apparatus according to claim 1, wherein if printing paper is loaded into the feed tray when the image forming apparatus is powered off or when a user is yet to be authenticated, the controller stores the paper-supplementing user for the feed tray as being unknown in the memory device, and if printing paper is loaded by an unknown paper-supplementing user, the controller requests a user who is authenticated first after the loading to check a condition of the loaded printing paper.

4. The image forming apparatus according to claim 1, wherein the paper loading detection unit is a circuit that detects presence/absence of printing paper loaded into the feed tray.

5. The image forming apparatus according to claim 4, wherein the feed tray is a drawer-type or detachable liftup tray, the paper loading detection unit includes a circuit that detects the feed tray being taken out and stored away or detached and reattached to raise the tray, and the controller controls the raising when the feed tray is taken out and stored away or detached and reattached, detects a stack size of the printing paper based on a raised position, and determines, based on a change that occurs in the stack size when the feed tray is taken out and stored away or detached and reattached, that new printing paper has been loaded.

6. An image forming method implemented by a controller for an image forming apparatus, the method comprising:

authenticating a user who is permitted to print;

detecting printing paper loaded into a feed tray through a paper loading detection unit;

storing, in a memory device, a user authenticated when the printing paper is loaded into the feed tray as a paper-supplementing user for the feed tray;

feeding the printing paper from the feed tray using a paper feeding mechanism;

detecting a paper jam during the paper feeding through a paper jam detection unit;

controlling printing on the printing paper having been fed;

when a paper jam has occurred, determining whether or not the paper jam is due to the paper-supplementing user having loaded the printing paper in an improper manner; and upon determining that the paper jam is due to the paper-supplementing user having loaded the printing paper in an improper manner, subsequently when the paper-supplementing user uses, requesting that a loading condition be checked.

* * * * *